United States Patent [19]

Striegel

[11] 4,229,496

[45] Oct. 21, 1980

[54] DECORATIVE LINKWORK

[75] Inventor: Oskar Striegel, Illingen-Schützingen, Fed. Rep. of Germany

[73] Assignee: Friedrich Münch Silber-und Alpaccawarenfabrik, Mühlacker, Fed. Rep. of Germany

[21] Appl. No.: 32,649

[22] Filed: Apr. 23, 1979

[30] Foreign Application Priority Data

Apr. 25, 1978 [DE] Fed. Rep. of Germany ..... 2818021

[51] Int. Cl.[2] ..... B32B 3/00; B32B 7/08

[52] U.S. Cl. ..... 428/53; 59/80; 63/2; 428/33; 428/52; 428/87; D11/93

[58] Field of Search ..... D11/93; 63/2; 59/80, 59/87; 428/2, 33, 52, 53, 187

[56] References Cited

U.S. PATENT DOCUMENTS

| | | | |
|---|---|---|---|
| 892,807 | 7/1908 | Canne | 63/2 |
| 1,582,749 | 5/1926 | Whiting | 428/52 X |
| 1,817,519 | 8/1931 | Mandalian | 428/52 |
| 2,139,512 | 12/1938 | Nagorny | 63/2 |
| 2,393,486 | 1/1946 | Storch | 428/52 X |
| 2,460,654 | 2/1949 | Reinstein | 428/52 |

*Primary Examiner*—George F. Lesmes
*Assistant Examiner*—R. Eugene Varndell, Jr.
*Attorney, Agent, or Firm*—Balogh, Osann, Kramer, Dvorak, Genova & Traub

[57] ABSTRACT

This is a decorative linkwork or mesh of interlinked parts which form a sheet for use as a decorative fabric. The linkwork is formed of small overlapping plates and interconnecting rings. Each plate has four outwardly extending arms which are formed into U-shaped hooks for engaging a respective connecting ring. At least one of the outwardly extending arms is relatively longer than the others and has a predetermined portion of its length folded back flat against the plate, resulting in a spacing between the edge of the plate and the beginning of the U-shaped hook formation of that arm.

4 Claims, 3 Drawing Figures

DECORATIVE LINKWORK

This invention relates to a decorative linkwork or mesh formed of overlapping plates to create a non-rigid sheet or fabric for use in such things as handbags and decorative articles of clothing, and the like.

The decorative linkwork or mesh sheet or fabrik is preferably made of small metal plates which have arm-like extensions projecting outwardly from each of preferably four sides. The plates with outwardly extending arms are most readily produced by stamping from sheet metal. The stamped metal plates are linked together by rings to form the linkwork or mesh sheet. To achieve interlinking the outwardly extending arms are bent back over inwardly of the respective edges of the metal plates to form U-shaped hook formations. Each U-shaped hook formation engages a separate ring, and consequently each plate, on the interior side of the linkwork or mesh sheet is engaged with four rings.

Metal linkwork or mesh sheets known in the prior art are generally characterized by having an undesirably great thickness. Although the outward appearance of the linkwork may be varied by changing the shape of the individual small metal plates, the plates are generally spaced apart from one another and do not overlap, and consequently, the overall outward appearance in the formed plane surface is determined solely by the shape of the small metal plates.

The object of the present invention is to provide a decorative scaled or imbricated linkwork or mesh sheet or a fabric formed of individual plates linked with one another in a manner so as to partly overlap one another, as in the form of scales of fish or reptiles. Such overlapping or scaling may take place in a single direction or in a plurality of directions in the linkwork or mesh sheet.

Scaled linkwork or mesh sheets as envisaged by the present invention, have not been successfully utilized in the prior art since the ring-engaging hooks formed by the outwardly extending arms on the "inner" or "reverse" side of the small plate did not permit a scaled or overlapping interlinking of the adjacent plates.

In accordance with the present invention, a surprisingly simple solution to this problem has been found. Particularly, the U-shaped hook formations of the outwardly extending arms can be positioned to regulate the amount of overlap of plates that will occur. Certain of the outwardly extending arms are formed into U-shaped hook formations directly at the edge of the respective plate while other arms are formed into U-shaped hook formations at a distance inwardly from the edge of the respective plate by including a folded-back flattened portion of the arm between the edge of the plate and the beginning of the U-shaped hook formation.

The scaled linkwork or mesh sheet of the present invention is advantageous over the prior art with regard to its simplicity in design and production. The present invention merely calls for one additional working operation over that known in the prior art, this being the formation of a flattened folded-back section of one or more of the outwardly extending arms.

The invention will be explained in greater detail in the accompanying drawings, wherein.

Reference to the "inner" or "reverse" side of the plate or the interconnected linkwork fabric refers to the side that reveals the interlinking as compared to the oposite side which is decorative and shows only the finished surface of the overlapping plates.

Figure 1:
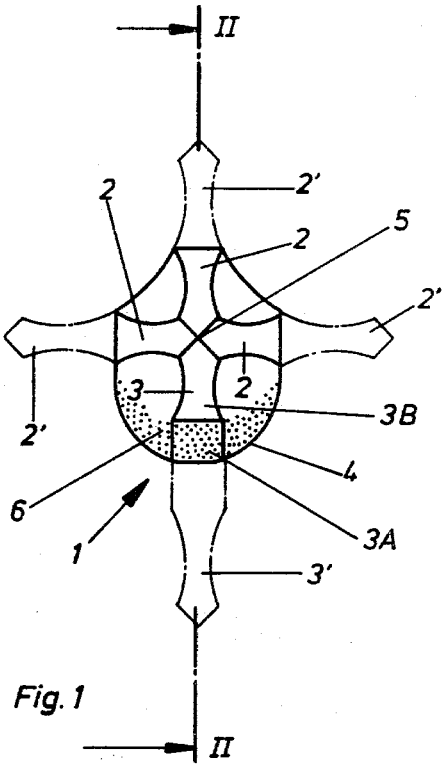
FIG. 1 shows a plan view of the "inner" or "reverse" side of one of the plates which form the linkwork, this view showing the outwardly extending arms in their unformed and in their formed positions.
Figure 2:
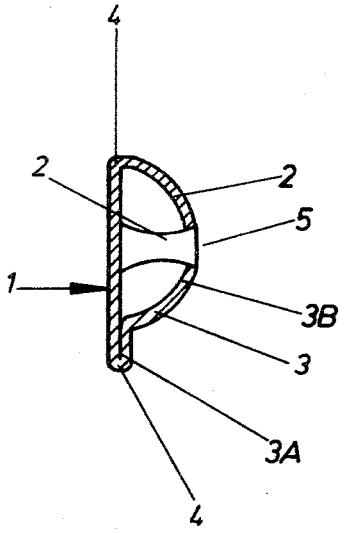
FIG. 2 is a cross-section view taken along lines II—II of FIG. 1, and more particularly, a section view showing the arms in formed condition.

FIG. 1 shows the "inner" or "reverse" side of a plate 1 having four outwardly extending arms 2', 2', 2', and 3'. The plate itself may be of any decorative shape or contour and need not necessarily be of the generally oval shape shown in FIG. 1. In the plate shown in FIG. 1, three of the arms 2' are of the same length, while the fourth arm 3' is of relatively longer length. The sheet can readily be stamped from a blank of metal or any similar stiff and formable material. Outwardly extending arms 2' and 3' are shown in dotted lines to represent the original preformed shape of the plate. In the form used in the linkwork assembly, the respective arms are bent inwardly into U-shaped hook formations as shown in FIG. 2. In the preferred form, the ends of the outwardly extending arms are cut in a predetermined shape so that the ends meet at a common point 5, spaced outwardly from the surface of the plate. The four U-shaped hook formations span the inner side of the plate in the manner of a cage or a vault. The width of the hook is such as to accommodate the thickness of the interconnecting ring 7.

The novelty of the present invention is shown in the unique formation of the U-shaped hook formation of arm 3. This arm is folded back inwardly from the edge 4 of the metal plate 1 for a length 3A. The remaining portion of the arm 3B assumes the substantially U-shaped hook formation of the other arms 2. Therefore, arm 3 is folded back sharply and contiguously at edge 4 of plate 1 for length 3A, whereupon the portion 3B assumes the U-shaped hook configuration extending to point 5. By this arrangement, any interconnecting ring 7 will necessarily have its engaged portion positioned inwardly from the edge 4 of plate 1.

By means of having three relatively shorter hook formations 2 of the same length, and one relatively longer hook formation 3, the outer ends of each of the arms meet at common point 5, which will not fall at the center of plate 1, but rather at some off-center point.

Figure 3:
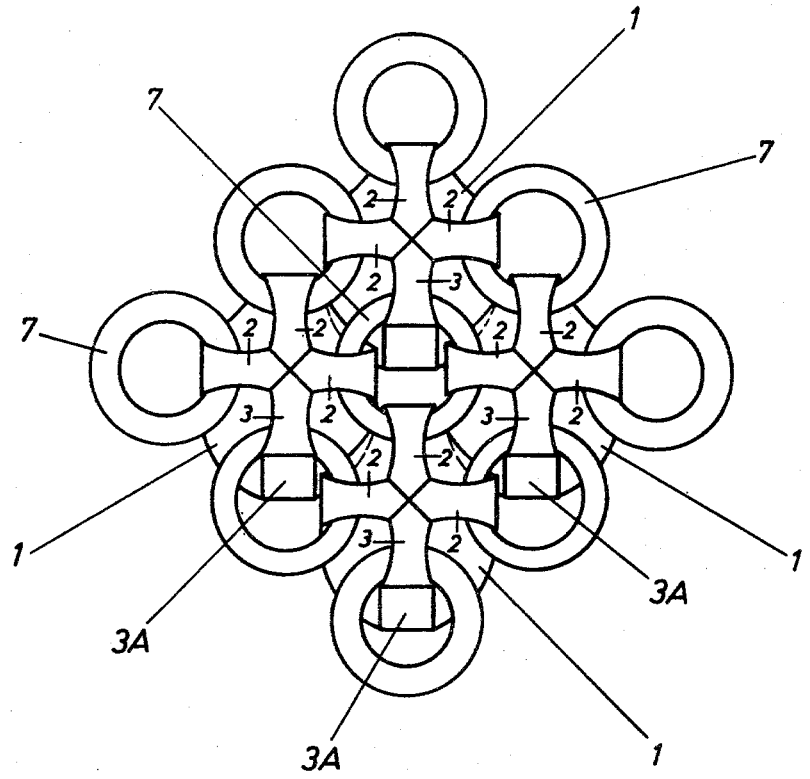
FIG. 3 shows the "inner" side of a portion of a scaled linkwork formed of a series of plates described in FIGS. 1 and 2 and interconnecting rings.

As a consequence of the flattened portion 3A of the U-shaped hook formation of arm 3, the uppermost plate will always overlap a lower plate, viewing from the "outer" side of the linkwork, or the opposite side of the linkwork from that shown in FIG. 3. The degree of overlap of the respective plates is more clearly shown by the dotted or shaded area 6 shown in FIG. 1 of the drawings. This overlap is also shown in FIG. 3 by means of dotted lines.

With respect to rings 7, these can be round or oval, or they may have straight sides, rather than being circular, the exact shape being a matter of choice. The relative thickness of the rings and the dimension of the U-shaped hook configurations of the outwardly extending arms will determine the amount of stiffness or flexibility of the final linkwork.

As can be seen from FIG. 3, the extent of overlapping of the plates is dependent upon the diameter of the ring 7 and the length of the flattened portion 3A of the outwardly extending arm 3.

Further combinations of unique overlapping might be accomplished through exercise of the present invention by having more than one arm formation 3 on each plate.

What is claimed is:

1. Decorative linkwork or mesh sheet formed of plates having outwardly extending arms, each of said outwardly extending arms being formed into U-shaped hook formations with the inner end of each arm extending inwardly of the outer edges of the plate, a separate interconnecting ring means engaging each of the U-shaped hook configurations of the arms of each of said plates, at least one of said outwardly extending arms being folded back inwardly from the edge of the plate and in contiguous contact with the rear surface of the plate for a predetermined length to form a spacing between the edge of the plate and the hook configuration of the respective arm, in order to permit an overlapping relationship of adjacent plates.

2. A decorative linkwork as claimed in claim 1, wherein said ring means is of circular configuration.

3. A decorative linkwork as claimed in claim 1, wherein said ring means is of non-circular configuration.

4. A decorative linkwork as claimed in claim 1, wherein the inner ends of each of the outwardly extending arms meet at a common point spaced outwardly from the surface of the respective plate.

* * * * *